US009702060B2

(12) United States Patent
Ferry et al.

(10) Patent No.: US 9,702,060 B2
(45) Date of Patent: Jul. 11, 2017

(54) METHOD OF PRODUCING POLYPROPYLENE SPUNBOND FIBERS

(71) Applicant: ExxonMobil Chemical Patents Inc., Baytown, TX (US)

(72) Inventors: William M. Ferry, Houston, TX (US); Galen C. Richeson, Humble, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 300 days.

(21) Appl. No.: 14/332,750

(22) Filed: Jul. 16, 2014

(65) Prior Publication Data

US 2014/0327164 A1 Nov. 6, 2014

Related U.S. Application Data

(62) Division of application No. 12/678,626, filed as application No. PCT/US2008/075368 on Sep. 5, 2008, now Pat. No. 9,212,432.

(60) Provisional application No. 60/984,223, filed on Oct. 31, 2007.

(51) Int. Cl.

| | |
|---|---|
| ***D01D 5/08*** | (2006.01) |
| ***D01D 5/00*** | (2006.01) |
| ***D01D 1/06*** | (2006.01) |
| ***D01F 6/06*** | (2006.01) |
| ***D04H 3/16*** | (2006.01) |

(52) U.S. Cl.

CPC ..... *D01D 5/0023* (2013.01); *D01D 1/065* (2013.01); *D01D 5/08* (2013.01); *D01F 6/06* (2013.01); *D04H 3/16* (2013.01); *D10B 2321/022* (2013.01); *Y10T 442/681* (2015.04)

(58) Field of Classification Search

CPC ..... D01D 1/065; D01D 5/0023; D01D 5/08; D10B 2321/022; D04H 3/16; Y10T 442/681

See application file for complete search history.

(56) References Cited

U.S. PATENT DOCUMENTS

| | | | | |
|---|---|---|---|---|
| 3,887,534 A | | 6/1975 | Baba et al. | |
| 3,940,379 A | | 2/1976 | Castagna et al. | |
| 4,451,589 A | | 5/1984 | Morman et al. | |
| 4,634,739 A | | 1/1987 | Vassilatos | |
| 4,707,524 A | | 11/1987 | Ehrig et al. | |
| 4,748,077 A | * | 5/1988 | Skinner | C08L 81/02 428/364 |
| 5,470,639 A | | 11/1995 | Gessner et al. | |
| 5,549,867 A | | 8/1996 | Gessner et al. | |
| 5,726,103 A | | 3/1998 | Stahl et al. | |
| 6,077,914 A | | 6/2000 | Arabinick et al. | |
| 6,235,664 B1 | | 5/2001 | Georgellis et al. | |
| 6,423,800 B1 | | 7/2002 | Musgrave | |
| 6,583,076 B1 | * | 6/2003 | Pekrul | D01F 6/06 442/327 |
| 2004/0102122 A1 | | 5/2004 | Boney et al. | |
| 2007/0134478 A1 | * | 6/2007 | Haberer | D01D 4/02 428/219 |
| 2010/0105274 A1 | | 4/2010 | Haubruge et al. | |

FOREIGN PATENT DOCUMENTS

| | | | | |
|---|---|---|---|---|
| EP | 1 964 948 | | 9/2008 | |
| FI | EP 1452630 A1 | * | 9/2004 | D01F 6/46 |
| JP | 59094610 | | 5/1984 | |
| JP | 2007/023398 | | 2/2007 | |
| WO | WO 01/94462 | | 12/2001 | |
| WO | WO 2007/142726 | | 12/2007 | |

OTHER PUBLICATIONS

A computerized English translation of JP 2007-023398 A, Nishimura et al. (Feb. 1, 2007), obtained from the European Patent Office.*

Berzin et al., "*Rheological Behavior of Controlled-Rheology Polypropylenes Obtained by Peroxide-Promoted Degradation During Extrusion: Comparison Between Homopolymer and Copolymer*", Journal of Applied Polymer Science, vol. 80, No. 8, pp. 1243-1252 (2001).

* cited by examiner

*Primary Examiner* — Jeremy R Pierce
(74) *Attorney, Agent, or Firm* — Kevin M. Faulkner

(57) ABSTRACT

Disclosed is a process for producing spunbond fibers comprising melt blending a polypropylene having a melt flow rate (230/2.16) of from 10 to 30 dg/min with a peroxide visbreaker such that the resulting melt flow rate of the visbroken polypropylene is from 50 to 100 dg/min; melt extruding the visbroken polypropylene through a die block such that filaments of the visbroken polypropylene being produced are exposed to a cabin pressure of from 4500 to 7000 Pa; and forming fibers of from less than 6.0 denier. Nonwoven fabrics and multiple-layer structures can be made from the fibers described herein that are useful for filtering and absorption related articles.

9 Claims, No Drawings

METHOD OF PRODUCING POLYPROPYLENE SPUNBOND FIBERS

CROSS-REFERENCE TO RELATED APPLICATION

The present application is a Divisional Application of, and claims priority to, U.S. Ser. No. 12/678,626 filed May 17, 2010, a National Phase Application from PCT/US2008/075368 filed Sep. 5, 2008, which claims priority to U.S. Ser. No. 60/984,223 filed on Oct. 31, 2007.

FIELD OF THE INVENTION

The present invention(s) relates to spunbond fibers made from visbroken polypropylene, and also relates to the formation of spunbond fibers and nonwoven fabrics.

BACKGROUND

The use of polypropylene in fibers accounts for at least one-third of the end use articles derived from polypropylene world wide. Spunbond fibers are common and can be used to make fabrics useful for a variety of end uses such as medical gowns, drapes, diapers and other filtering and liquid-absorbing articles. Methods of forming polypropylenes useful in making fibers, and the properties of those fibers has been the subject of numerous patents, including U.S. Pat. No. 3,887,534; U.S. Pat. No. 4,451,589; U.S. Pat. No. 4,707,524; U.S. Pat. No. 5,726,103; and U.S. Pat. No. 6,235,664.

The wide ranging uses of spunbond polypropylene have lead to the development of spunbonding equipment capable of higher throughput. This increases the demands upon the base polypropylene, typically a controlled rheology (or "visbroken") polypropylene. While current spunbonding equipment can produce spunbond fibers at increasing throughput, the fibers must still maintain the ability to form fabrics having the desired degree of softness and durability. Thus, polypropylene fibers of narrow denier (for softness) and high spin tension (toughness for higher throughput) are needed. What would be desirable is a spunbond fiber made from a visbroken polypropylene, and a process for forming such, that meets today's higher demands.

SUMMARY

The inventors have found that by creating a visbroken polypropylene having a higher melt flow rate (for increased throughput) yet having a retention of high molecular weight polymer strands (high $M_z/M_w$), improved spunbond fibers result therefrom that can be made at increased throughputs.

Described in one embodiment is a spunbond fiber of from less than 6.0 denier consisting essentially of visbroken polypropylene having an $M_w/M_n$ of from 3.5 to 7.0, an $M_z/M_w$ of from greater than 2.0, and from 2.0 to 3.5 in another embodiment, and a melt flow rate (230/2.16) of from 50 to 100 dg/min.

Described in another embodiment is a process for producing spunbond fibers comprising in one embodiment providing a polypropylene having a melt flow rate (230/2.16) of from 10 to 30 dg/min; melt blending the polypropylene with a peroxide visbreaker such that the resulting melt flow rate of the visbroken polypropylene is from 50 to 100 dg/min; melt extruding the visbroken polypropylene through a die block such that filaments of the visbroken polypropylene being produced are exposed to a cabin pressure of from 4500 to 7000 Pa; and forming fibers of from less than 6.0 denier.

The various descriptive elements and numerical ranges disclosed herein can be combined with other descriptive elements and numerical ranges to describe preferred embodiments of the invention(s); further, any upper numerical limit of an element can be combined with any lower numerical limit of the same element to describe preferred embodiments.

DETAILED DESCRIPTION

The term "polypropylene" as used herein refers to both propylene homopolymers ("hPP") and copolymers of propylene and ethylene and/or a $C_4$ to $C_{10}$ α-olefin, wherein the amount of ethylene and/or a $C_4$ to $C_{10}$ α-olefin ranges from 0.1 wt % to 5 wt % of the propylene copolymer, and ranges from 0.2 to 2 wt % in another embodiment. Further, the term "polypropylene" refers to the reactor-made polymer, not having been treated in any manner that would cross-link and/or break the carbon-carbon bonds of the polymer backbone after having left the reactor in which it was produced. In a particular embodiment, the polypropylene is a propylene homopolymer (including only propylene derived units). The polypropylene useful in making spunbond fibers described herein can be produced by any means known in the art (catalyst and process), and has a molecular weight distribution ("MWD", $M_w/M_n$) of from 4.0 or 4.2 or 4.5 to 5 or 5.5 or 6.0 or 7.0 in certain embodiments. In yet other embodiments the polypropylene has a melt flow rate ("MFR", ASTM 1238, 230° C./2.16 kg) of from 10 or 12 or 14 to 18 or 20 or 24 or 28 or 30 dg/min, wherein a desirable range comprises any upper limit can be combined with any lower limit. In yet another embodiment, the polypropylene has an $M_n$ ranging from 35,000 to 61,000, and from 37,500 to 58,000 in another embodiment; and has an $M_z$ value of from greater than 477,000 in one embodiment, and from 477,000 to 800,000 in one embodiment, and from 480,000 to 750,000 in yet another embodiment, and from 490,000 to 700,000 in yet another embodiment, wherein a desirable range comprises any upper limit can be combined with any lower limit.

The principles of weight average molecular weight ($M_w$), number average molecular weight ($M_n$) and z-average molecular weight ($M_z$) are well known in the art. These parameters can be determined by means known in the art such as by chromatography. Molecular weight, number molecular weight and z-average molecular weight was characterized using a High Temperature Size Exclusion Chromatograph (PL 220, Polymer Laboratories), equipped with a differential refractive index (DRI) detector. Three Polymer Laboratories PL gel 10 mm Mixed-B columns were used. The nominal flow rate was 1.0 $cm^3$/min, and the nominal injection volume was 300 μL. The various transfer lines, columns and the DRI detector were contained in an oven maintained at 160° C. Polymer solutions were prepared in filtered 1,2,4-Trichlorobenzene (TCB) containing about 1000 ppm of butylated hydroxy toluene (BHT). The same solvent was used as the SEC eluent. Polymer solutions were prepared by dissolving the desired amount of dry polymer in the appropriate volume of SEC eluent to yield concentration of 1.5 mg/ml. The sample mixtures were heated at 160° C. with continuous agitation for 2 hours. Sample solution will be filtered off-line before injecting to GPC with 2 μm filter using the Polymer Labs SP260 Sample Preparation Station. The separation efficiency of the column set was calibrated using a series of narrow MWD polystyrene standards, which reflects the expected MW range for samples and the exclusion limits of the column set. Seventeen individual polystyrene standards, ranging from Mp about 580 to 10,000,000, were used to generate the calibration curve. The polystyrene standards are obtained from Polymer Laboratories (Amherst, Mass.). To assure internal consistency, the flow rate is corrected for each calibrant run to give a common peak position for the flow rate marker (taken to be the positive inject peak) before determining the retention volume for each polystyrene standard. The flow marker peak position thus assigned was also used to correct the flow rate when analyzing samples; therefore, it is an essential part of the calibration procedure. A calibration curve (log Mp vs. retention volume) is generated by recording the retention volume at the peak in the DRI signal for each PS standard, and fitting this data set to a 2nd-order polynomial. The equivalent polypropylene molecular weights are determined by using the following Mark-Houwink coefficients in Table 1:

TABLE 1

| | k (dl/g) | a |
|---|---|---|
| Polystyrene | $1.75 \times 10^{-4}$ | 0.67 |
| Polypropylene | $2.288 \times 10^{-4}$ | 0.705 |

In one embodiment is a spunbond fiber consisting essentially of a visbroken polypropylene. The "visbroken polypropylene" (also known in the art as controlled rheology or "CR") is a polypropylene that has been treated with a visbreaking agent such that the agent breaks apart the polymer chains. Stated another way, the visbroken polypropylene is the reaction product of a visbreaking agent and a polypropylene. In particular, a visbroken polypropylene is one that has been treated with a visbreaking agent such that its MFR is increased, in one embodiment by at least 10%, and at least 20% in another embodiment. In one embodiment the visbreaking agent is a peroxide, and an organic peroxide in another embodiment, wherein at least a methyl group or higher alkyl or aryl is bound to one or both oxygen atoms of the peroxide. In yet another embodiment, the visbreaking agent is a sterically hindered peroxide, wherein the alkyl or aryl group associated with each oxygen atom is at least a secondary carbon, a tertiary carbon in another embodiment. Non-limiting examples of sterically hindered peroxides ("visbreaking agents") includes 2,5-bis(tert-butylperoxy)-2,5-dimethylhexane, 2,5-dimethyl-2,5-bis-(t-butylperoxy)-hexyne-3,4-methyl-4-t-butylperoxy-2-pentanone, 3,6,6,9,9-pentamethyl-3-(ethylacetate)-1,2,4,5-textraoxy cyclononane, and α,α'-bis-(tert-butylperoxy)diisopropyl benzene, and mixtures of these and any other secondary- or tertiary-hindered peroxides.

In one embodiment, the spunbond fiber has a denier (weight in grams of fiber per 9000 meters of fiber) of from less than 6.00 denier, and from less than 4.00 denier in another embodiment, and from less than 2.00 denier in yet another embodiment, and from less than 1.70 in yet another embodiment, and from 1.10 to 6.00 denier in another embodiment, and from 1.20 to 4.00 denier in yet another embodiment, and from 1.25 to 2.00 denier in yet another embodiment, and from 1.20 to 1.80 in yet another embodiment, and from 1.10 to 4.00 denier in yet another embodiment, wherein a desirable range of denier can comprise any upper limit with any lower limit.

In certain embodiments, the spunbond fiber consists essentially of visbroken polypropylene having an $M_w/M_n$ of from 3.5 or 3.6 or 3.8 or 4.0 to 4.5 or 5.5 or 6.0 or 6.5 or 7.0, wherein a desirable range of $M_w/M_n$ can comprise any upper limit with any lower limit, for example, a range of from 3.5 to 6.0. In one embodiment, the visbroken polypropylene possesses a $M_z/M_w$ of from greater than 2.0, and greater than 2.1 in another embodiment, and from greater than 2.2 in yet another embodiment, and in yet other embodiments from 2.0 or 2.1 or 2.2 or 2.3 to 2.8 or 3.0 or 3.5 or 3.8 or 4.0 or 4.5 or 5.0 or 6.0 or 7.0, wherein a desirable range of $M_z/M_n$ can comprise any upper limit with any lower limit, for example, a range of from 2.0 to 2.8.

In yet another embodiment, the visbroken polypropylene possesses an $M_n$ value of from 25,000 to 44,000, and from 26,000 to 46,000 in yet another embodiment. The visbroken polypropylene possesses an $M_z$ value of from 310,000 to 600,000 in one embodiment, and from 330,000 to 550,000 in yet another embodiment.

In one embodiment, the visbroken polypropylene has a melt flow rate (230° C./2.16 kg) of greater than 40 or 50 or 60 dg/min, and from 50 to 100 dg/min in another embodiment, and from 50 to 80 dg/min in another embodiment, and from 55 to 70 in yet another embodiment, and from 50 to 70 in yet another embodiment. An advantage of the visbroken polypropylene is that it possesses a larger amount of long chain (high molecular weight) polymer strands compared to other visbroken polypropylenes, as characterized by its $M_z/M_w$ values. This gives the spunbond fibers described herein an advantageously high spin tension and melt strength. Practically, this advantage translates into finer fibers achieved at higher throughputs.

In one embodiment, the visbroken polypropylene is visbroken propylene homopolymer.

In one embodiment, the visbroken polypropylene comprises up to 3 wt % of one or more additives, or up to 2 wt % in another embodiment, based on the weight of the visbroken polypropylene and additive(s). Additives can include, for example, stabilizers, antioxidants, fillers, colorants, nucleating agents, mold release agents, slip agents, waxes, processing oils, and mixtures thereof. Thus, by the use of the phrase "consisting essentially of," it is not meant to exclude such additives up to 2 or 3 wt % by weight of the visbroken polypropylene.

Also described herein is a process for producing spunbond fibers. The spunbonding process involves the process of melt-extruding the visbroken polypropylene material through one or more spinnerets comprising at least one die having small diameter holes, the stream of molten polypropylene then being attenuated (drawn) by high pressure air, creating a venturi effect. The visbroken polypropylene may have been added to the melt-extruder as visbroken pellets, or polypropylene may be added and visbroken upon separate addition of the visbreaker in the melt-extruder just as it is then made into fibers.

The visbreaking treatment can be carried out by any means known in the art, preferably by melt blending the visbreaker with a polypropylene in a single or double screw extruder, or a Banbury mixer, or other melt blending means. The melt blending of the polypropylene and peroxide takes place at a temperature of from 200 to 300° C. in one embodiment, and from 210 to 280° C. in another embodiment, and from 215 to 270° C. in yet another embodiment, wherein a desirable range comprises any upper limit with any lower temperature limit, such as, for example, 215 to 300° C. Any suitable amount of visbreaker can be used, as long as the final MFR of the visbroken polypropylene ranges at least from 50 dg/min to at the most 100 dg/min. In one embodiment, from 300 to 1000 ppm of visbreaker is used, and from 400 to 900 ppm in yet another embodiment. This visbroken polypropylene can then be formed into pellets that can later be processed into spunbond fibers, or can be used directly from the melt into the spunbonding equipment.

Upon visbreaking, the MFR of the polypropylene increases due to the lowering of the molecular weight of the polymer. Also, the MWD ($M_w/M_n$) decreases relative to the non-visbroken polypropylene. The advantage to this narrowing of MWD is that, while high MFR is useful for increased throughput, narrow MWD tends to improve the orientation during the attenuation (draw down) of the filaments of visbroken polypropylene and gives better spinning continuity and strain hardens more quickly, thus being less likely to fail.

In any case, the formation of visbroken polypropylene filaments is accomplished by quenching the molten material (having a desirable melt temperature within the die) with a cross-flow air quench system, then pulled away from the one or more spinnerets and thus attenuated. To accomplish this, the filaments are attenuated inside of a closed system having, due to the high pressure air flow, a certain cabin pressure. The higher the cabin pressure, the more the polypropylene is attenuated, both in terms of speed and denier of the fiber that is formed therefrom. To achieve finer fibers, high cabin pressures are desirable. However, this must be balanced by the tendency for the filaments to break due to excessive pressure. The visbroken polypropylenes described herein can be attenuated using higher cabin pressures than is typical in other spunbond processes. In one embodiment, the cabin pressure used in the spunbonding process ranges from 4500 to 7000 Pa, and from 4700 to 6500 Pa in yet another embodiment, and from 4800 to 6300 Pa in yet another embodiment, wherein any upper pressure limit may be combined with any lower pressure limit to obtain a desirable range or cabin pressure.

Pressure in the die block in one embodiment is generated by a gear pump. The method of forming the pressure in the die block is not critical, but the pressure inside the die block ranges from 35 to 50 bar (3500 to 5000 kPa) in one embodiment, and from 36 to 48 bar (3600 to 4800 kPa) in another embodiment, and from 37 to 46 bar (3700 to 4600 kPa) in yet another embodiment. Expressed another way, the die pressure for the inventive spunbond process is from 30 to 40% lower than the die pressure (using the same die, throughput within 5 kg/hr of the inventive process and melt temperature within 3° C. of the inventive process) of a 30 to 40 dg/min (230/2.16) propylene homopolymer having an MWD of from 2.7 to 3.3.

The melt temperature in the die of the visbroken polypropylene melt ranges from 200 to 260° C. in one embodiment, and from 200 to 250° C. in yet another embodiment, and ranges from 210 to 245° C. in yet another embodiment.

Any number of spinnerets including any number of dies can be used. In one embodiment, a die is used that contains from 4000 to 9000 holes per meter, and from 4500 to 8500 holes per meter in another embodiment, and from 5000 to 8000 holes per meter in yet another embodiment, wherein any upper die hole limit may be combined with any lower die hole to obtain a desirable range of die holes.

It is well known in the art how air attenuation is accomplished. In one embodiment, the venturi effect is obtained by drawing the filaments of visbroken polypropylene using an aspirator slot (slot draw), which runs the width of the machine. In another embodiment, the venturi effect is obtained by drawing the filaments through a nozzle or aspirator gun. Multiple guns can be used, since orifice size can be varied to achieve the desired effect. Filaments of the visbroken polypropylene thus formed are collected onto a screen ("wire") in one embodiment, or porous forming belt in another embodiment to form a fabric of the filaments. Typically, a vacuum is maintained on the underside of the belt to promote the formation of a uniform fabric and to remove the air used to attenuate the filaments and creating the cabin pressure. The actual method of air attenuation is not critical, as long as the desirable cabin pressure, and hence venturi effect, is obtained to attenuate the visbroken polypropylene filaments.

In one embodiment, the process of forming a spunbond fiber first includes the process of visbreaking a polypropylene, preferably a propylene homopolymer. As described above, the visbreaker is an organic peroxide in one embodiment, and a sterically hindered organic peroxide in yet another embodiment. One embodiment is a process for producing spunbond fibers comprising providing a polypropylene, preferably a propylene homopolymer, having a melt flow rate (230/2.16) of from 10 to 30 dg/min, and from 14 to 24 dg/min in yet another embodiment, and from 14 to 20 dg/min in yet another embodiment; melt blending the polypropylene with a peroxide visbreaker such that the resulting melt flow rate of the visbroken polypropylene ranges from 50 to 100 dg/min, or any suitable range as described above; then melt extruding the visbroken polypropylene through a die block such that filaments of the visbroken polypropylene being produced are exposed to a cabin pressure of from 4500 to 7000 Pa, or any other suitable range as described herein; and forming fibers of from less than 6.00 or 4.00 or 2.00 denier, or any other denier as is described herein.

With the visbroken polypropylenes described herein, relatively high throughputs can be achieved in the spunbond equipment. In one embodiment, the throughput of the visbroken polypropylene in forming filaments is greater than 200 or 300 or 400 or 500 or 600 kg/hour; and in certain embodiments is within the range of from 220 to 1000 kg/hour, and ranges from 250 to 800 kg/hour in yet another embodiment, and ranges from 250 to 600 kg/hr in yet another embodiment, and ranges from 300 to 500 kg/hr in yet another embodiment.

Yet another embodiment is a process for producing spunbond fibers comprising providing visbroken polypropylene having an $M_w/M_n$, of from 3.5 to 4.5, an $M_z/M_w$ of from greater than 2.0, and from 2.0 to 3.5 in another embodiment, and a melt flow rate (230/2.16) of from 50 to 100 dg/min; melt extruding the visbroken polypropylene through a die block such that filaments of the visbroken polypropylene being produced are exposed to a cabin pressure of from 4500 to 7000 Pa; and forming fibers of from less than 6.00 denier.

In another embodiment is the formation of spunbond (nonwoven) fabric, and the fabric itself. In forming fabrics from the visbroken polypropylene, there are any number of ways of dispersing the filaments to form a uniform fabric. In one embodiment, a deflector is used, either stationary or moving. In another embodiment, static electricity or air turbulence is used to improve fabric uniformity. Other means may also be used as is known in the art. In any case, the formed fabric typically passes through compression rolls to improve fabric integrity. The fabric, in one embodiment, is then passed between heated calender rolls where the raised lands on one roll bond the fabric at certain points to further increase the spunbonded fabric integrity. The compression and heated calender can be isolated from the area where the filaments are formed in one embodiment.

The nonwoven fabrics formed from the spunbond fibers and spunbond process described herein have a number of uses. Non-limiting examples of such uses include filters, medical gowns, carpet yarn, medical drapes, diapers, feminine care products, cleaning wipes and other liquid-absorbing articles. The fabrics can make up the end use article itself, or be one of several components and/or layers making up the article. A non-limiting example of such a component is a three or more layer fabric comprising a melt blown polypropylene layer sandwiched between at least two sheets of spunbond material (commonly referred to as "SMS" structures). Thus, certain embodiments of the fabrics described herein are directed to a nonwoven fabric comprising (or consisting essentially of) a spunbond fiber as described herein; in one embodiment the fiber is from less than 6.00 denier, from 1.20 to 4.00 denier in yet another embodiment, comprising (or consisting essentially of) visbroken polypropylene having an $M_w/M_n$ of from 3.5 to 4.5, an $M_z/M_w$ of from greater than 2.0, and a melt flow rate (230/2.16) of from greater than 50 dg/min.

Examples

An example of an inventive visbroken polypropylene was prepared as follows: the starting polypropylene material was a reactor (Ziegler-Natta) produced propylene homopolymer having a melt flow rate (ASTM 1238, 230° C./2.16 kg) of 16 dg/min and a MWD ($M_w/M_n$) of 4.5. This propylene homopolymer was visbroken at from 225 to 260° C. using about 750 ppm Lupersol™ 101 (2,5-bis(tert-butylperoxy)-2,5-dimethylhexane) in a melt extruder to a MFR of 65 dg/min and a MWD of about 4.0, as measured by gel permeation chromatography (GPC) (inventive (a) in Table 2). As a reference, under the same conditions, a second reactor (Ziegler-Natta) produced (MFR of 4.5 dg/min, MWD of 3.27) propylene homopolymer, was visbroken with Lupersol 101 to a melt flow rate of about 36 dg/min and a molecular weight distribution of about 3.0 (reference (a) in Table 2). The extruder had two feeders, one for polymer and one for the peroxide visbreaker. The temperature profile for the extruder from zones 1 to 10 was: 204/218/218/218/218/221/224/224/224/249° C. The $M_z$, $M_n$, and $M_w$ values for the visbroken hPPs were measured by gel permeation chromatography (GPC) as described above, and recorded in Table 2. The values are an average of at least two measurements, and the error in the $M_z/M_w$ measurement was ±3%.

In another set of experiments, the molecular weight characteristics of a sample of PP3155 having an MFR of 4.6 dg/min was measured (reference (b1) in Table 2), then the sample was visbroken to 65 dg/min using the same peroxide as for reference (a), and its molecular weight characteristics recorded (reference (b2) Table 2). Also, the molecular weight characteristics of a inventive reactor grade propylene homopolymer made using a Ziegler catalyst having an MFR of 20 dg/min was measured using GPC (inventive (c1) in Table 2). This inventive (c1) homopolymer was visbroken as for inventive (a) and the GPC data recorded in Table 2 (inventive (c2)).

The visbroken propylene homopolymer (inventive (a)) and propylene homopolymer reference (reference (a)) were then used to form spunbond fibers and fabric in a spunbond extruder/spinneret under the conditions in Table 3. Table 4 contains the data for a second line. The spinneret in each die possessed 7400 holes in 1.1 meter width die, or 6700 holes/meter. Both lines were combined to form a nonwoven fabric.

Properties of these spunbond fibers and fabrics were measured and are shown in Table 5. Tensile strength and elongation (TD and CD) of the fabrics were measured by ASTM D882-95a. The fiber thickness is expressed as "denier" and is the weight in grams per 9000 meters of fiber as is commonly known in the art. The conditions for making the fabrics from the fibers, and properties therein, are in Table 6. The other conditions are as in Tables 3 and 4 in making the fibers.

The spin tension of a sample of a visbroken reference fiber (PP3155, MFR of 35 dg/min, ExxonMobil Chemical Co.) was 44 grams at 2500 m/min, while the spin tension of a sample of the inventive fibers (MFR of 65 dg/min) was 43 grams at 2500 m/min, thus very similar, yet with the higher MFR, there was lower pressure within the die for the inventive visbroken polypropylene, which is an advantage. The spin tension was measured using a tensiometer, Check-Line™ Model # Z150-04626. The calibration is a simple zeroing of the device. While running the fiber line and going to the winder at various speeds, the tensiometer is moved into place (in line with the fiber bundle). Then, using hooks, the fiber was thread through the wheels of the tensiometer and a reading taken in grams. The spin tension of the fiber was measured at a temperature of about 232° C., the temperature of the molten fibers coming out of the spinnerette (spin face/die). From there the fiber was quenched (at about 15° C.) using cooled air blowing across the fiber bundle as it was let down to the tensiometer. The spinnerette of the tensiometer had 72 individual holes, and each hole was about 0.34 mm in diameter at a given RPM. The fiber diameter was controlled based on controlling the winder speed and/or controlling the metering pump speed. The winder speed and pump speed were the same for comparison measurements.

TABLE 2

Visbroken hPP Properties

| Sample | MFR, dg/min | $M_w$ | $M_n$ | $M_z$ | $M_w/M_n$ | $M_z/M_w$ |
|---|---|---|---|---|---|---|
| Reference (a) | 35 | 165,550 | 55,420 | 352,739 | 3.00 | 2.10 (±3%) |
| Inventive (a) | 65 | 150,722 | 38,556 | 335,003 | 4.00 | 2.20 (±3%) |
| Reference (b1) {hPP prior to visbreaking} | 4.6 | 203,163 | 62,122 | 476,854 | 3.27 | 2.35 |
| Reference (b2) | 65 | 150,809 | 45,317 | 301,880 | 3.33 | 2.00 |
| Inventive (c1) {hPP prior to visbreaking} | 20 | 222,308 | 39,569 | 643,752 | 5.62 | 2.90 |
| Inventive (c2) | 65 | 183,416 | 31,837 | 466,124 | 5.76 | 2.54 |

TABLE 3

Spunbond Line Conditions, Line 1

| Sample | Line Speed (m/min) | Fabric Weight (g/m$^2$) | Suction Blower/ LayDown Suction Blower (rpm) | Cooling Blower (rpm) | Cooling Air Temp. (° C.) | Cabin Pressure (Pa) | Spin Pump (rpm) | Pressure Inside Die (bar) | Through put (kg/h) | Melt Temp. Inside The Die (° C.) |
|---|---|---|---|---|---|---|---|---|---|---|
| Ref. 1 | 280 | 15 | 1699/1800 | 1831 | 20 | 4394 | 46 | 61 | 277 | 235 |
| Ref. 2 | 274 | 15 | 1700/1800 | 1834 | 20 | 4398 | 46 | 61 | 277 | 235 |
| Ref. 3 | 211 | 20 | 1700/1799 | 1841 | 20 | 4394 | 46 | 61 | 277 | 236 |
| Ref. 4 | 103 | 40 | 1700/1800 | 1850 | 20 | 4417 | 46 | 61 | 277 | 235 |
| Ref. 5 | 305 | 15 | 1700/1800 | 2024 | 20 | 5278 | 46 | 64 | 300 | 235 |
| Inv. 1 | 211 | 20 | 1700/1800 | 2050 | 20 | 5505 | 46 | 45 | 277 | 228 |
| Inv. 2 | 274 | 15 | 1700/1800 | 2055 | 20 | 5468 | 46 | 44 | 277 | 228 |
| Inv. 3 | 274 | 15 | 1700/1800 | 2058 | 20 | 5514 | 46 | 42 | 277 | 235 |
| Inv. 4 | 211 | 20 | 1700/1800 | 2200 | 20 | 6296 | 46 | 41 | 277 | 236 |
| Inv. 5 | 274 | 15 | 1700/1800 | 2201 | 20 | 6282 | 46 | 41 | 277 | 236 |

TABLE 4

Spunbond Line Conditions, Line 2

| Sample | Line Speed (m/min) | Fabric Weight (g/m$^2$) | Suction Blower/ LayDown Suction Blower (rpm) | Cooling Blower (rpm) | Cooling Air temp. (° C.) | Cabin Pressure (Pa) | Spin Pump (rpm) | Pressure Inside Die (bar) | Through put (kg/h) | Melt Temp. inside the die (° C.) |
|---|---|---|---|---|---|---|---|---|---|---|
| Ref. 1 | 280 | 15 | 1699/1800 | 1740 | 20 | 4394 | 39 | 52 | 277 | 237 |
| Ref. 2 | 274 | 15 | 1700/1800 | 1741 | 20 | 4398 | 39 | 52 | 277 | 237 |
| Ref. 3 | 211 | 20 | 1700/1799 | 1749 | 20 | 4394 | 39 | 52 | 277 | 237 |
| Ref. 4 | 103 | 40 | 1700/1800 | 1758 | 20 | 4417 | 39 | 52 | 277 | 237 |
| Ref. 5 | 305 | 15 | 1700/1800 | 1924 | 20 | 5278 | 45 | 53 | 300 | 237 |
| Inv. 1 | 211 | 20 | 1700/1800 | 1947 | 20 | 5505 | 39 | 36 | 277 | 231 |
| Inv. 2 | 274 | 15 | 1700/1800 | 1952 | 20 | 5468 | 39 | 35 | 277 | 231 |
| Inv. 3 | 274 | 15 | 1700/1800 | 1956 | 20 | 5514 | 39 | 32 | 277 | 238 |
| Inv. 4 | 211 | 20 | 1700/1800 | 2090 | 20 | 6296 | 39 | 32 | 277 | 239 |
| Inv. 5 | 274 | 15 | 1700/1800 | 2090 | 20 | 6282 | 39 | 32 | 277 | 239 |

TABLE 5

Spunbond Fiber and Fabric Properties From Combined Lines 1 and 2

| Sample | Fiber Thickness (μm) | Fiber Denier | MD Tensile (N/5 cm) | CD Tensile (N/5 cm) | MD Elongation % | CD Elongation % |
|---|---|---|---|---|---|---|
| Ref. 1 | 16.5 | 1.75 | 32.5 | 19.9 | 83 | 86 |
| Ref. 2 | — | — | 32.3 | 19.5 | 79 | 76 |
| Ref. 3 | — | — | 44.6 | 26.7 | 78 | 77 |
| Ref. 4 | — | — | 109.3 | 74.5 | 96 | 101 |
| Ref. 5 | — | — | 33.2 | 20.1 | 76 | 92 |
| Inv. 1 | — | — | 44.0 | 25.5 | 63 | 68 |
| Inv. 2 | — | — | 32.5 | 19.4 | 62 | 71 |
| Inv. 3 | — | — | 32.9 | 17.5 | 51 | 62 |
| Inv. 4 | 1.5 | 1.39 | 50.1 | 27.2 | 71 | 78 |
| Inv. 5 | 14.7 | 1.39 | 50.1 | 27.2 | 71 | 78 |

TABLE 6

Fabric Producing Conditions and Properties of Fabrics

| Sample | Line Speed (m/min) | Fabric Weight (g/m$^2$) | Calendar Temp/SET (° C.) | Embossing Roll Temp. (° C.) | S-Roll Temp. (° C.) | Nip Pressure (N/mm) | Heated Press Roll Set/Act. (° C.) | Fabric Weight (ACT) (g/m$^2$) |
|---|---|---|---|---|---|---|---|---|
| Ref. 1 | 280 | 15 | 153/150 | — | — | 80 | 50 | 14.6 |
| Ref. 2 | 274 | 15 | 156/152 | 143 | 145 | 80 | 50 | 15.9 |
| Ref. 3 | 211 | 20 | 158/154 | 146 | 148 | 80 | 50 | 19.8 |
| Ref. 4 | 103 | 40 | 166/189 | — | — | 80 | 50 | 40.4 |
| Ref. 5 | 305 | 15 | 156/158 | — | — | 80 | 50 | 14.6 |
| Inv. 1 | 211 | 20 | 159/155 | 145 | 147 | 80 | 50 | 20.4 |
| Inv. 2 | 274 | 15 | 159/155 | 145 | 147 | 80 | 50 | 15.2 |

TABLE 6-continued

Fabric Producing Conditions and Properties of Fabrics

| Sample | Line Speed (m/min) | Fabric Weight ($g/m^2$) | Calendar Temp/SET (° C.) | Embossing Roll Temp. (° C.) | S-Roll Temp. (° C.) | Nip Pressure (N/mm) | Heated Press Roll Set/Act. (° C.) | Fabric Weight (ACT) ($g/m^2$) |
|---|---|---|---|---|---|---|---|---|
| Inv. 3 | 274 | 15 | 159/155 | 145 | 147 | 80 | 50 | — |
| Inv. 4 | 211 | 20 | 159/155 | 145 | 147 | 80 | 50 | — |
| Inv. 5 | 274 | 15 | 159/155 | 145 | 147 | 80 | 50 | — |

Having described the various elements of the apparatus and methods, described herein in numbered embodiments is:

1. A spunbond fiber of from less than 6.00 denier consisting essentially of visbroken polypropylene having an $M_z/M_w$ of from greater than 2.0, and a melt flow rate (230/2.16) of greater than 50 dg/min, and from 50 to 100 dg/min in a particular embodiment.
2. The fiber of embodiment 1, wherein the visbroken polypropylene has an $M_w/M_n$, of from 3.5 to 7.0.
3. The fiber of embodiment 1 or 2, wherein the polypropylene is propylene homopolymer.
4. The fiber of any of the preceding numbered embodiments, wherein the $M_z/M_w$ of the visbroken polypropylene is from 2.2 to 3.0.
5. The fiber of any of the preceding numbered embodiments, wherein the polypropylene comprises up to 3 wt %, based on the weight of the polypropylene, of additives.
6. A process for producing the spunbond fiber of any of the preceding numbered embodiments comprising:

providing a polypropylene having a melt flow rate (230/2.16) of from 10 to 30 dg/min;

melt blending the polypropylene with a visbreaking agent such that the resulting melt flow rate of the visbroken polypropylene is from 50 to 100 dg/min;

melt extruding the visbroken polypropylene through a die block such that filaments of the visbroken polypropylene being produced are exposed to a cabin pressure of from 4500 to 7000 Pa; and forming fibers of from less than 6.00 denier.

7. The process of embodiment 6, wherein the fibers are further directed to a receiver mat to form a spunbond fabric.
8. The process of embodiments 6 and 7, wherein the cabin pressure ranges from 4700 to 6500 Pa.
9. The process of any of embodiments 6 through 8, wherein the throughput of the visbroken polypropylene in forming filaments is greater than 200 kg/hr, and in another embodiment is within the range of from 220 to 1000 kg/hour.
10. The process of any of embodiments 6 through 9, wherein the pressure inside the die block ranges from 35 to 45 bar (3500 kPa to 4500 kPa).
11. The process of any of embodiments 6 through 10, wherein the pressure inside the die block ranges from 30 to 40% lower than the die pressure when a 30 to 40 dg/min (230/2.16) propylene homopolymer having an MWD of from 2.7 to 3.3 is formed into a spunbond fiber under the same die, throughput and melt temperature conditions.
12. The process of any of embodiments 6 through 11, wherein the visbreaking agent is an organic peroxide.
13. The process of any of embodiment 12, wherein the organic peroxide is a sterically hindered organic peroxide.
14. The process of any of embodiments 6 through 13, wherein the polypropylene has an $M_w/M_n$ of from 4.0 to 7.0.
15. The fiber of any of the preceding claims having a melt flow rate of at least 50 or 60 dg/min and a spin tension of less than 40 or 42 or 43 or 45 grams at 2500 m/min, and within the range of from 5 or 10 to 40 or 43 or 45 grams in yet another embodiment.

Described in yet another embodiment is the use of a spunbond fiber of from less than 6.00 denier, from 1.20 to 2.00 denier in another embodiment, consisting essentially of visbroken polypropylene having an $M_w/M_n$ of from 3.5 to 7.0, an $M_z/M_w$ of from greater than 2.0, and from 2.0 to 3.5 in another embodiment, and a melt flow rate (230/2.16) of greater than 50 dg/min, and from 50 to 100 dg/min in a particular embodiment.

In yet another embodiment is the use of a nonwoven fabric comprising a spunbond fiber of from less than 6.00 denier, from 1.20 to 2.00 denier in another embodiment, consisting essentially of visbroken polypropylene having an $M_w/M_n$ of from 3.5 to 7.0, an $M_z/M_w$ of from greater than 2.0, and from 2.0 to 3.5 in another embodiment, and a melt flow rate (230/2.16) of greater than 50 dg/min, and from 50 to 100 dg/min in a particular embodiment.

The invention claimed is:

1. A process for producing spunbond fibers consisting essentially of:

providing a polypropylene having a melt flow rate (230/2.16) of from 10 to 30 dg/min;

melt blending the polypropylene with a visbreaking agent such that the resulting melt flow rate of the visbroken polypropylene is from 50 to 100 dg/min, wherein the visbroken polypropylene has a $M_z/M_w$ from 2.0 to 2.8, and the visbroken polypropylene has an $M_w/M_n$ of from 3.5 to 7.0;

melt extruding the visbroken polypropylene through a die block such that filaments of the visbroken polypropylene being produced are exposed to a cabin pressure of from 4500 to 7000 Pa, wherein the throughput of the visbroken polypropylene in forming filaments is greater than 200 kg/hour; and forming fibers of from less than 6.00 denier;

wherein the pressure inside the die block ranges from 35 to 45 bar (3500 to 4500 kPa).

2. The process of claim 1, wherein the fibers are further directed to a receiver mat to form a spunbond fabric.

3. The process of claim 1, wherein the cabin pressure ranges from 4700 to 6500 Pa.

4. The process of claim 1, wherein the visbroken polypropylene has an $M_z/M_w$ of 2.0 to 2.54.

5. The process of claim 1, wherein the visbroken polypropylene has an $M_w/M_n$ of from 3.6 to 6.5.

6. The process of claim 1, wherein the throughput of the visbroken polypropylene in forming filaments is within a range from 220 to 1000 kg/hour.

7. The process of claim 1, wherein the pressure inside the die block ranges from 30 to 40% lower than the die pressure when a 30 to 40 dg/min (230/2.16) propylene homopolymer having an MWD of from 2.7 to 3.3 is formed into a spunbond fiber under the same die, throughput and melt temperature conditions.

8. The process of claim 1, wherein the melt temperature of the die block ranges from 200 to 260° C.

9. The process of claim 1, forming fibers of from less than 2.00 denier.

* * * * *